US005853505A

United States Patent [19]

Brauer et al.

[11] Patent Number: 5,853,505

[45] Date of Patent: Dec. 29, 1998

[54] IRON MODIFIED TIN BRASS

[75] Inventors: Dennis R. Brauer, Brighton, Ill.; John F. Breedis, Trumbull, Conn.; Ronald N. Caron, Branford, Conn.; Carl Deppisch, Hamden, Conn.

[73] Assignee: Olin Corporation, New Haven, Conn.

[21] Appl. No.: 844,478

[22] Filed: Apr. 18, 1997

[51] Int. Cl.[6] ..... C22C 9/02

[52] U.S. Cl. ..... 148/433; 420/472; 420/473

[58] Field of Search ..... 148/433; 420/472, 420/473

[56] References Cited

U.S. PATENT DOCUMENTS

| | | | |
|---|---|---|---|
| 130,702 | 8/1872 | Dick | 420/469 |
| 632,233 | 9/1899 | Bull | 420/472 |
| 2,128,954 | 9/1938 | Montgomery et al. | 420/472 |
| 2,128,955 | 9/1938 | Montgomery et al. | 420/472 |
| 2,210,670 | 8/1940 | Kelly | 420/473 |
| 3,039,867 | 6/1962 | McLain | 420/496 |
| 3,639,119 | 2/1972 | McLain | 420/473 |
| 3,698,965 | 10/1972 | Ence | 148/411 |
| 3,930,894 | 1/1976 | Shapiro et al. | 148/554 |
| 4,249,941 | 2/1981 | Futatsaka et al. | 420/473 |
| 4,486,250 | 12/1984 | Nakajima | 148/433 |
| 4,586,967 | 5/1986 | Shapiro et al. | 428/469 |
| 4,627,960 | 12/1986 | Nakajima et al. | 420/472 |
| 4,666,667 | 5/1987 | Kamio et al. | 420/471 |
| 4,822,562 | 4/1989 | Miyafuji et al. | 420/472 |
| 4,935,076 | 6/1990 | Yamaguchi et al. | 148/433 |
| 5,370,840 | 12/1994 | Caron et al. | 420/492 |

FOREIGN PATENT DOCUMENTS

| | | |
|---|---|---|
| 57-68061 | 4/1982 | Japan . |
| 63-67539 | 7/1983 | Japan . |
| 68-218701 | 12/1983 | Japan . |
| 61-243141 | 10/1986 | Japan . |
| 63-266049 | 11/1988 | Japan . |
| 1-165733 | 6/1989 | Japan . |
| 02107730 | 4/1990 | Japan . |
| 02163331 | 6/1990 | Japan . |
| 03111529 | 5/1991 | Japan . |
| 03162536 | 7/1991 | Japan . |
| 03193849 | 8/1991 | Japan . |
| 04231443 | 8/1992 | Japan . |
| 4231430 | 8/1992 | Japan . |
| 05009619 | 1/1993 | Japan . |
| 05214465 | 8/1993 | Japan . |
| 07054079 | 5/1995 | Japan . |
| 07062472 | 7/1995 | Japan . |
| WO 8701138 | 1/1987 | WIPO . |

OTHER PUBLICATIONS

"Recent Developments in Properties and Protection of Copper for Electrical Uses" by S.G. Temple, appearing in Metallurgical Reviews, vol. 11 (1966) (The Institute of Metals 1966) at pp. 47–60.

ASM Handbook, Formerly Tenth Edition, Metals Handbook. vol. 2. "Properties and Selection: Nonferrous Alloys and Special–Purpose Materials" (1990).

*Primary Examiner*—Sikyin Ip

*Attorney, Agent, or Firm*—Gregory S. Rosenblatt; Wiggin & Dana

[57] ABSTRACT

There is provided a tin brass alloy having a grain structure that is refined by the addition of controlled amounts of both zinc and iron. Direct chill cast alloys containing from 1% to 4%, by weight of tin, from 0.8% to 4% of iron, from an amount effective to enhance iron initiated grain refinement to 20% of zinc and the remainder copper and inevitable impurities are readily hot worked. The zinc addition further increases the strength of the alloy and improves the bend formability in the "good way", perpendicular to the longitudinal axis of a rolled strip.

12 Claims, 7 Drawing Sheets

IRON MODIFIED TIN BRASS

BACKGROUND OF THE INVENTION

1. Field of the Invention

This invention relates to copper alloys having high strength, good formability and relatively high electrical conductivity. More particularly, the yield strength of a tin brass is increased through a controlled addition of iron.

2. Description of Related Art

Throughout this patent application, all percentages are given in weight percent unless otherwise specified.

Commercial tin brasses are copper alloys containing from 0.35%–4% tin, up to 0.35% phosphorous, from 49% to 96% copper and the balance zinc. The alloys are designated by the Copper Development Association (CDA) as copper alloys C40400 through C49080.

One commercial tin brass is a copper alloy designated as C42500. The alloy has the composition 87%–90% of copper, 1.5%–3.0% of tin, a maximum of 0.05% of iron, a maximum of 0.35% phosphorous and the balance zinc. Among the products formed from this alloy are electrical switch springs, terminals, connectors, fuse clips, pen clips and weather stripping.

The ASM Handbook specifies copper alloy C42500 as having a nominal electrical conductivity of 28% IACS (International Annealed Copper Standard where "pure" copper is assigned a conductivity value of 100% IACS at 20° C.) and a yield strength, dependent on temper, of between 45 ksi and 92 ksi. The alloy is suitable for many electrical connector applications, however the yield strength is lower than desired.

It is known to increase the yield strength of certain copper alloys through controlled additions of iron. For example, commonly owned United States patent application Ser. No. 08/591,065 entitled "Iron Modified Phosphor-Bronze" by Caron et al. that was filed on Feb. 9, 1996, discloses the addition of 1.65%–4.0% of iron to phosphor bronze. The Caron et al. alloy has an electrical conductivity in excess of 30% IACS and an ultimate tensile strength in excess of 95 ksi.

U.S. patent application Ser. No. 08/591,065 is incorporated by reference in its entirety herein.

Japanese patent application number 57-68061 by Furukawa Metal Industries Company, Ltd. discloses a copper alloy containing 0.5%–3.0%, each, of zinc, tin and iron. It is disclosed that iron increases the strength and heat resistance of the alloy.

While the benefit of an iron addition to phosphor-bronze is known, iron causes problems for the alloy. The electrical conductivity of the alloy is degraded and processing of the alloy is impacted by the formation of stringers. Stringers form when the alloy contains more than a critical iron content, which content is dependent on the alloy composition. The stringers originate when properitectic iron particles precipitate from liquid prior to solidification and elongate during mechanical deformation. Stringers are detrimental because they affect the surface appearance of the alloy and can degrade the formability characteristics.

In high copper (in excess of 85% Cu) tin brasses, the maximum permissible iron content, as an impurity, is typically 0.05%. This is because iron is known to reduce electrical conductivity and, through the formation of stringers, deteriorate the bend properties.

There exists, therefore, a need for an iron modified tin brass alloy that does not suffer from the stated disadvantages of reduced electrical conductivity and stringer formation.

SUMMARY OF THE INVENTION

Accordingly, it is an object of the invention to provide a tin brass alloy having increased strength. It is a feature of the invention that the increased strength is achieved by an addition of controlled amounts of a combination of iron and zinc. It is another feature of the invention that by processing the alloy according to a specified sequence of steps, a fine microstructure is retained in the wrought alloy.

Among the advantages of the alloy of the invention are that the yield strength is increased without a degradation in electrical conductivity. The microstructure of a refined as-cast alloy, grain size less than 100 microns, and a wrought alloy, grain size of about 5–20 microns, is fine grain. Still another advantage is that the electrical conductivity is about equal to that of copper alloy C42500 with a significant increase in yield strength.

In accordance with the invention, there is provided a copper alloy. This alloy consists essentially of from 1% to 4% by weight of tin, from 0.8% to 4.0% by weight of iron, from an amount effective to enhance iron initiated grain refinement to 20% by weight of zinc, up to 0.4% by weight of phosphorus and the remainder is copper, as well as inevitable impurities.

The grain refined alloy has an average as-cast grain size of less than 100 microns and an average grain size after processing of between about 5 and 20 microns.

The above stated objects, features and advantages will become more apparent from the specification and drawings that follow.

IN THE DRAWINGS

FIG. 1 is a flow chart illustrating one method of processing the alloy of the invention.

FIG. 2 graphically illustrates the effect of iron content on the yield strength.

FIG. 3 graphically illustrates the effect of iron content on the ultimate tensile strength.

FIG. 4 graphically illustrates the effect of tin content on the yield strength.

FIG. 5 graphically illustrates the effect of tin content on the ultimate tensile strength.

FIG. 6 graphically illustrates the effect of zinc content on the yield strength.

FIG. 7 graphically illustrates the effect of zinc content on the ultimate tensile strength.

DETAILED DESCRIPTION

Figure 1:
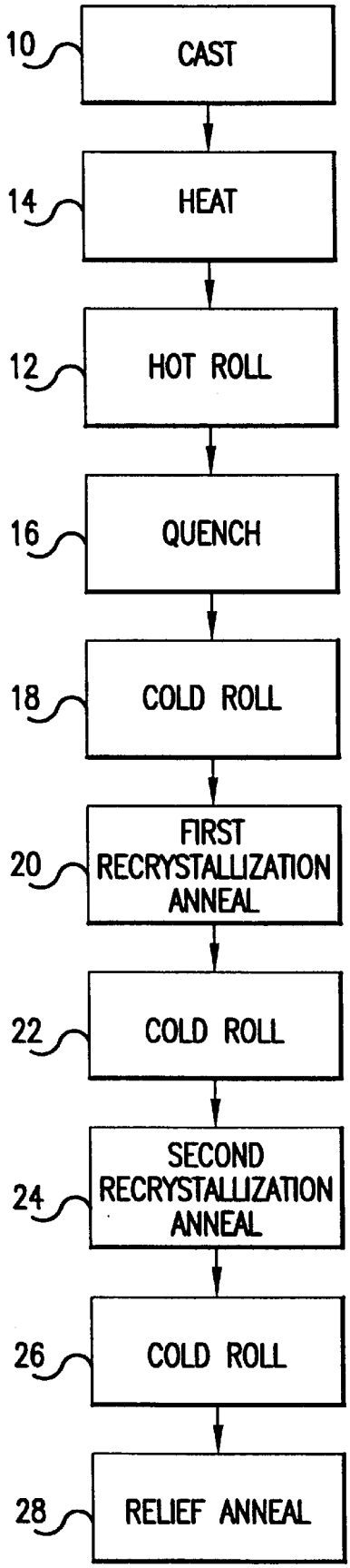

The copper alloys of the invention are an iron modified tin brass. The alloys consist essentially of from 1% to 4% of tin, from 0.8% to 4.0% of iron, from 5% to 20% of zinc, up to 0.4% of phosphorus and the remainder is copper along with inevitable impurities. As cast, the grain refined alloy has an average crystalline grain size of less than 100 microns.

When the alloy is cast by direct chill casting, in preferred embodiments, the tin content is from 1.5% to 2.5% and the iron content is from 1.6% to 2.2%. 1.6% of iron has been found to be a critical minimum to achieve as-cast grain refinement. Most preferably, the iron content is from 1.6% to 1.8%.

Tin

Tin increases the strength of the alloys of the invention and also increases the resistance of the alloys to stress relaxation.

The resistance to stress relaxation is recorded as percent stress remaining after a strip sample is preloaded to 80% of the yield strength in a cantilever mode per ASTM (American Society for Testing and Materials) specifications. The strip is heated to 125° C. for the specified number of hours and retested periodically. The properties were measured at up to 3000 hours at 125° C. The higher the stress remaining, the better the utility of the specified composition for spring applications.

However, the beneficial increases in strength and resistance to stress relaxation are offset by reduced electrical conductivity as shown in Table 1. Further, tin makes the alloys more difficult to process, particularly during hot processing. When the tin content exceeds 2.5%, the cost of processing the alloy may be prohibitive for certain commercial applications. When the tin content is less than 1.5%, the alloy lacks adequate strength and resistance to stress relaxation for spring applications.

TABLE 1

| Composition | Electrical Conductivity (% IACS) | Yield Strength (ksi) |
|---|---|---|
| 88.5% Cu<br>9.5% Zn<br>2% Sn<br>0.2% P | 26 | 75 |
| 87.6% Cu<br>9.5% Zn<br>2.9% Sn<br>0.2% P | 21 | 83 |
| 94.8% Cu<br>5% Sn<br>0.2% P | 17 | 102 |

Preferably, the tin content of the alloys of the invention is from about 1.2% to about 2.2% and most preferably from about 1.4% to about 1.9%.

Iron

Iron refines the microstructure of the as-cast alloy and increases strength. The refined microstructure is characterized by an average grain size of less than 100 microns. Preferably, the average grain size is from 30 to 90 microns and most preferably, from 40 to 70 microns. This refined microstructure facilitates mechanical deformation at elevated temperatures, such as rolling at 850° C.

When the iron content is less than about 1.6%, the grain refining effect is reduced and coarse crystalline grains, with an average grain size on the order of 600–2000 microns, develop. When the iron content exceeds 2.2%, excessive amount of stringers develop during hot working.

The effective iron range, 1.6%–2.2%, differs from the iron range of the alloys disclosed in Caron et al. patent application Ser. No. 08/591,065. Caron et al. disclose that grain refinement was not optimized until the iron content exceeded about 2%. The ability to refine the grain structure at lower iron contents in the alloys of the present invention was unexpected and believed due to a phase equilibrium shift due to the inclusion of zinc. To be effective, this phase shift interaction requires a minimum zinc content of about 5%.

Large stringers, having a length in excess of about 200 microns, are expected to form when the iron content exceeds about 2.2%. The large stringers impact both the appearance of the alloy surface as well as the properties, electrical and chemical, of the surface. The large stringers can change the solderability and electro-platability of the alloy.

To maximize the grain refinement and strength increase attributable to iron without the detrimental formation of stringers, the iron content should be maintained between about 1.6% and 2.2% and preferably, between about 1.6% and 1.8%.

Zinc

The addition of zinc to the alloys of the invention would be expected to provide a moderate increase in strength with some decrease in electrical conductivity. While, as shown in Table 2, this occurred, surprisingly, with a minimum of 5% zinc present, the grain refining capability of the iron addition was significantly enhanced.

TABLE 2

| Composition | Electrical Conductivity (% IACS) | Tensile Strength (ksi) |
|---|---|---|
| 1.8 Sn<br>2.2 Fe<br>balance Cu | 33 | 99 |
| 1.8 Sn<br>2.2 Fe<br>5 Zn<br>balance Cu | 29 | 99 |
| 1.8 Sn<br>2.2 Fe<br>10 Zn<br>balance Cu | 25 | 108 |

(Tensile strength measured following 70% cold reduction)

Preferably, the zinc content is from that effective to enhance iron initiated grain refinement to about 20%. More preferably, the zinc content is from about 5% to about 15% and most preferably, the zinc content is from about 8% to about 12%.

Other additions

Phosphorous is added to the alloy for conventional reasons, to prevent the formation of copper oxide or tin oxide precipitates and to promote the formation of iron phosphides. Phosphorous causes problems with the processing of the alloy, particularly with hot rolling. It is believed that the iron addition counters the detrimental impact of phosphorous. At least a minimal amount of iron must be present to counteract the impact of the phosphorous.

A suitable phosphorous content is any amount up to about 0.4%. A preferred phosphorous content is from about 0.03% to 0.3%.

Other elements that remain in solution when the copper alloy solidifies may be present in amounts of up to 20% and may substitute, at a 1:1 atomic ratio, for either a portion of the zinc. The preferred ranges of these solid-state soluble elements are those specified for zinc. Among the preferred elements are manganese and aluminum.

Cobalt may be added as a partial substitute for iron. Cobalt less effectively refines the grain structure of the alloys of the invention. Therefore, the sum of Fe+0.6Co should equal the iron ranges specified herein.

Less preferred are additions of elements that affect the properties of the alloy. Although, additions such as nickel, aluminum, magnesium, beryllium, silicon, zirconium, titanium, chromium and mixtures thereof may be included.

For example, nickel additions severely reduce electrical conductivity. As a result, the less preferred additions are preferably present in an amount of less than about 0.4% and most preferably, in an amount of less than about 0.2%. Most preferably, the sum of all less preferred alloying additions is less than about 0.5%.

Processing

The alloys of the invention are preferably processed according to the flow chart illustrated in FIG. 1. An ingot, being an alloy of a composition specified herein, is cast 10 by a conventional process such direct chill casting. The alloy is hot rolled 12, at a temperature of from about 650° C. to about 950° C. and preferably, at a temperature of between about 825° C. and 875° C. Optionally, the alloy is heated 14 to maintain the desired hot roll 12 temperature.

The hot rolling reduction is, typically, by thickness, up to 98% and preferably, from about 80% to about 95%. The hot rolling may be in a single pass or in multiple passes, provided that the temperature of the ingot is maintained at above 650° C.

After hot rolling 12, the alloy is, optionally, water quenched 16. The bars are then mechanically milled to remove surface oxides and then cold rolled 18 to a reduction of at least 60%, by thickness, from the gauge at completion of the hot roll step 12, in either one or multiple passes. Preferably, the cold roll reduction 18 is from about 60%–90%.

The strip is then annealed 20 at a temperature between about 400° C. and about 600° C. for a time of from about 0.5 hour to about 8 hours to recrystallize the alloy. Preferably, this first recrystallization anneal is at a temperature between about 500° C. and about 600° C. for a time between 3 and 5 hours. These times are for bell annealing in an inert atmosphere such as nitrogen or in a reducing atmosphere such as a mixture of hydrogen and nitrogen.

The strip may also be strip annealed, such as for example, at a temperature of from about 600° C. to about 950° C. for from 0.5 minute to 10 minutes.

The first recrystallization anneal 20 causes additional precipitates of iron and iron phosphide to develop. These precipitates control the grain size during this and subsequent anneals, add strength to the alloy via dispersion hardening and increase electrical conductivity by drawing iron out of solution from the copper matrix.

The bars are then cold rolled 22 a second time to a thickness reduction of from about 30% to about 70% and preferably of from about 35% to about 45%.

The strip is then given a second recrystallization anneal 24, utilizing the same times and temperatures as the first recrystallization anneal. After both the first and second recrystallization anneals, the average grain size is between 3 and 20 microns. Preferably, the average grain size of the processed alloy is from 5 to 10 microns.

The alloys are then cold rolled 26 to final gauge, typically on the order of between 0.010 inch and 0.015 inch. This final cold roll imparts a spring temper comparable to that of copper alloy C51000.

The alloys are then relief annealed 28 to optimize resistance to stress relaxation. One exemplary relief anneal is a bell anneal in an inert atmosphere at a temperature of between about 200° C. and about 300° C. for from 1 to 4 hours. A second exemplary relief anneal is a strip anneal at a temperature of from about 250° C. to about 600° C. for from about 0.5 minutes to about 10 minutes.

Following the relief anneal 28, the copper is alloy strip is formed into a desired product such as a spring or an electrical connector.

The advantages of the alloys of the invention will become more apparent from the examples that follow.

EXAMPLES

Example 1

Copper alloys containing 10.5% zinc, 1.7% tin, 0.04% phosphorous, between 0% and 2.3% iron and the balance copper were prepared according to the process of FIG. 1. Following the relief anneal 28, the yield strength and the ultimate tensile strength of sample coupons, 2 inch gauge length, were measured at room temperature (20° C.).

The 0.2% offset yield strength and the tensile strength were measured on a tension testing machine (manufactured by Tinius Olsen, Willow Grove, Pa.).

Figure 2:
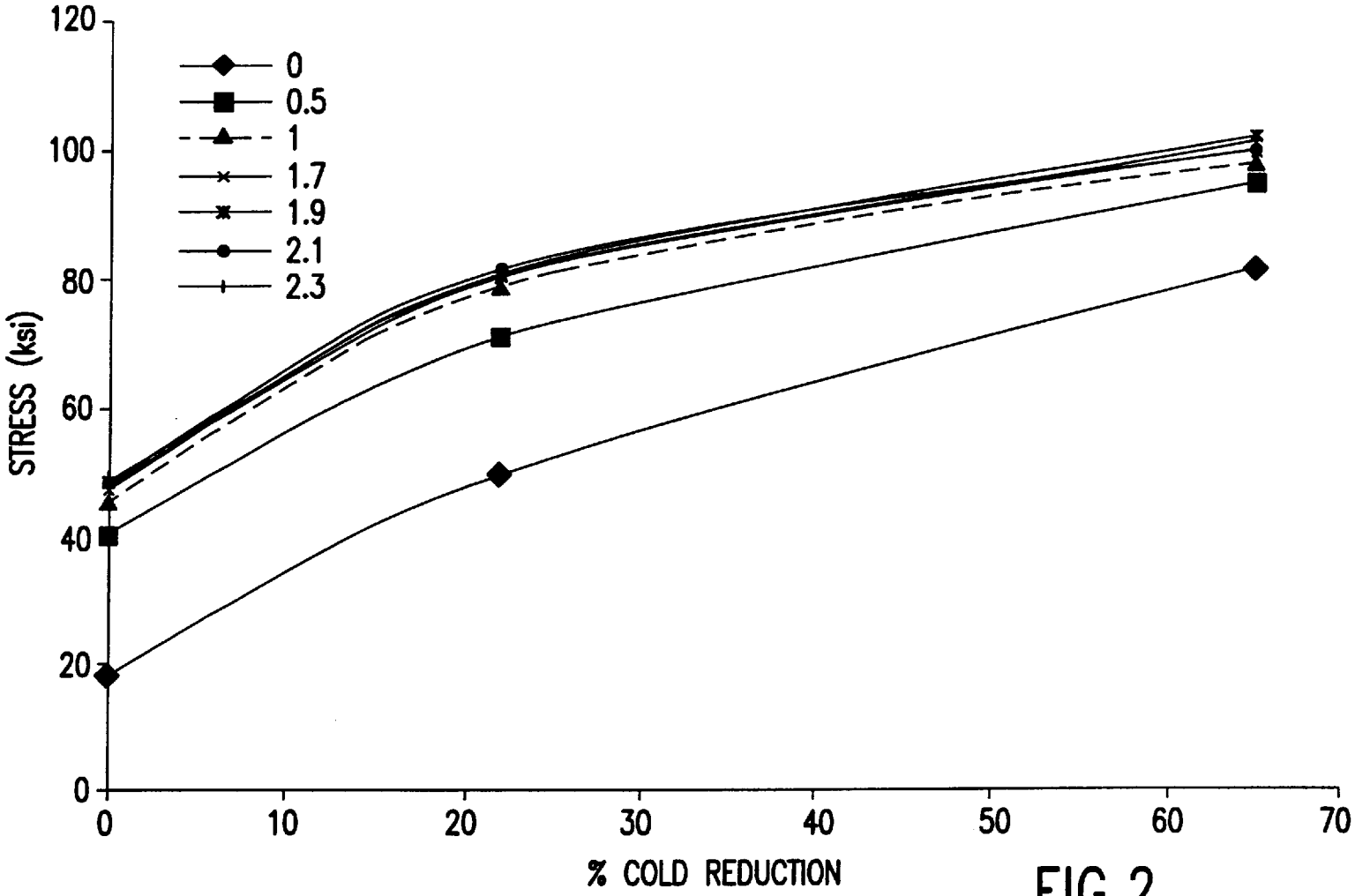

As shown in FIG. 2, increasing the iron from 0% to 1% led to a significant increase in yield strength. Further increases in the iron content had only a minimal effect on strength, but increased the likelihood of stringers.

Figure 3:
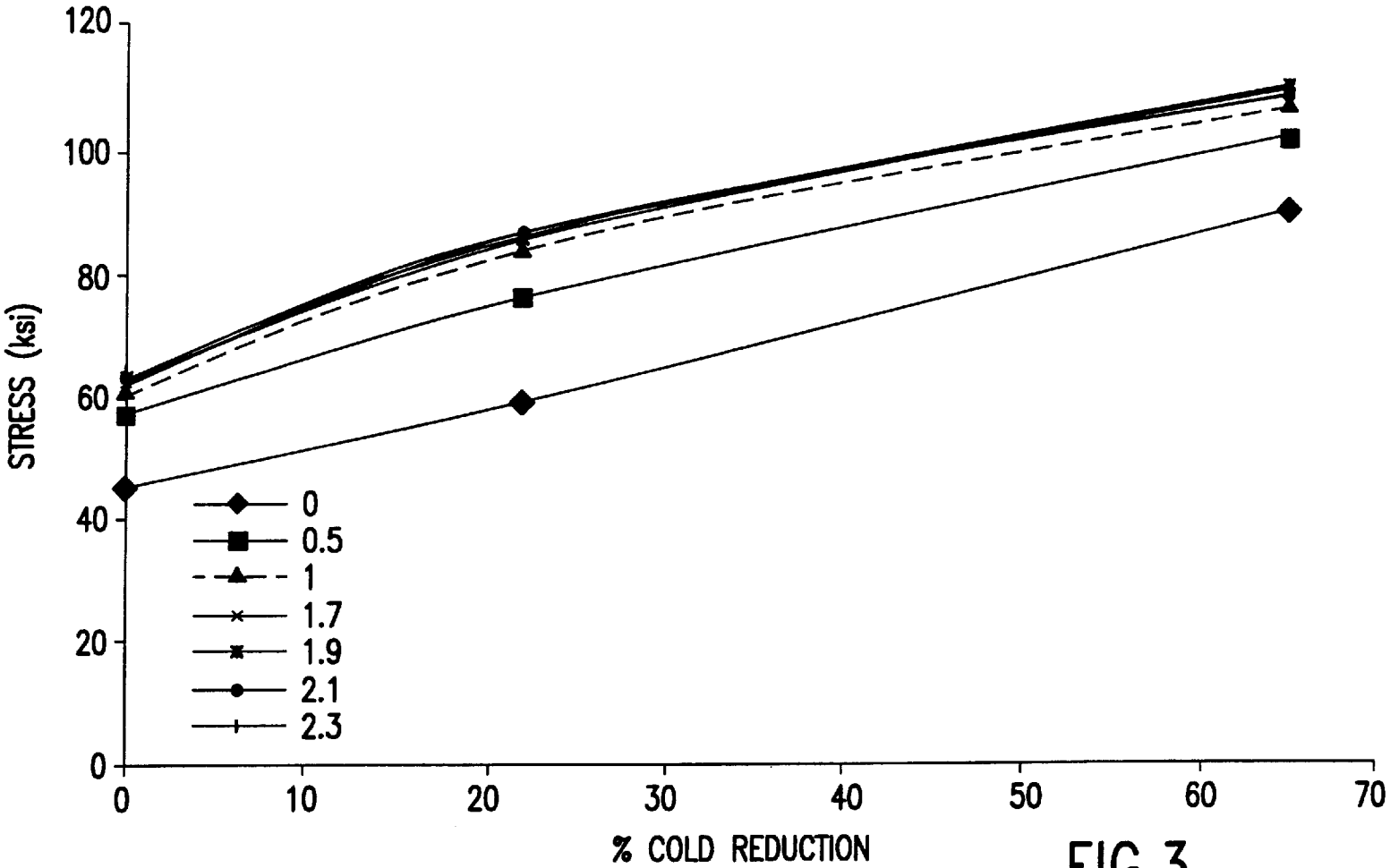

FIG. 3 graphically illustrates a similar relationship between the iron content and the ultimate tensile strength.

Example 2

Copper alloys containing 10.4% zinc, 1.8% iron, 0.04% phosphorous, between 1.8% and 4.0% tin and the balance copper were processed according to FIG. 1. Test coupons in the relief anneal condition 28, were evaluated for yield strength and ultimate tensile strength.

Figure 4:
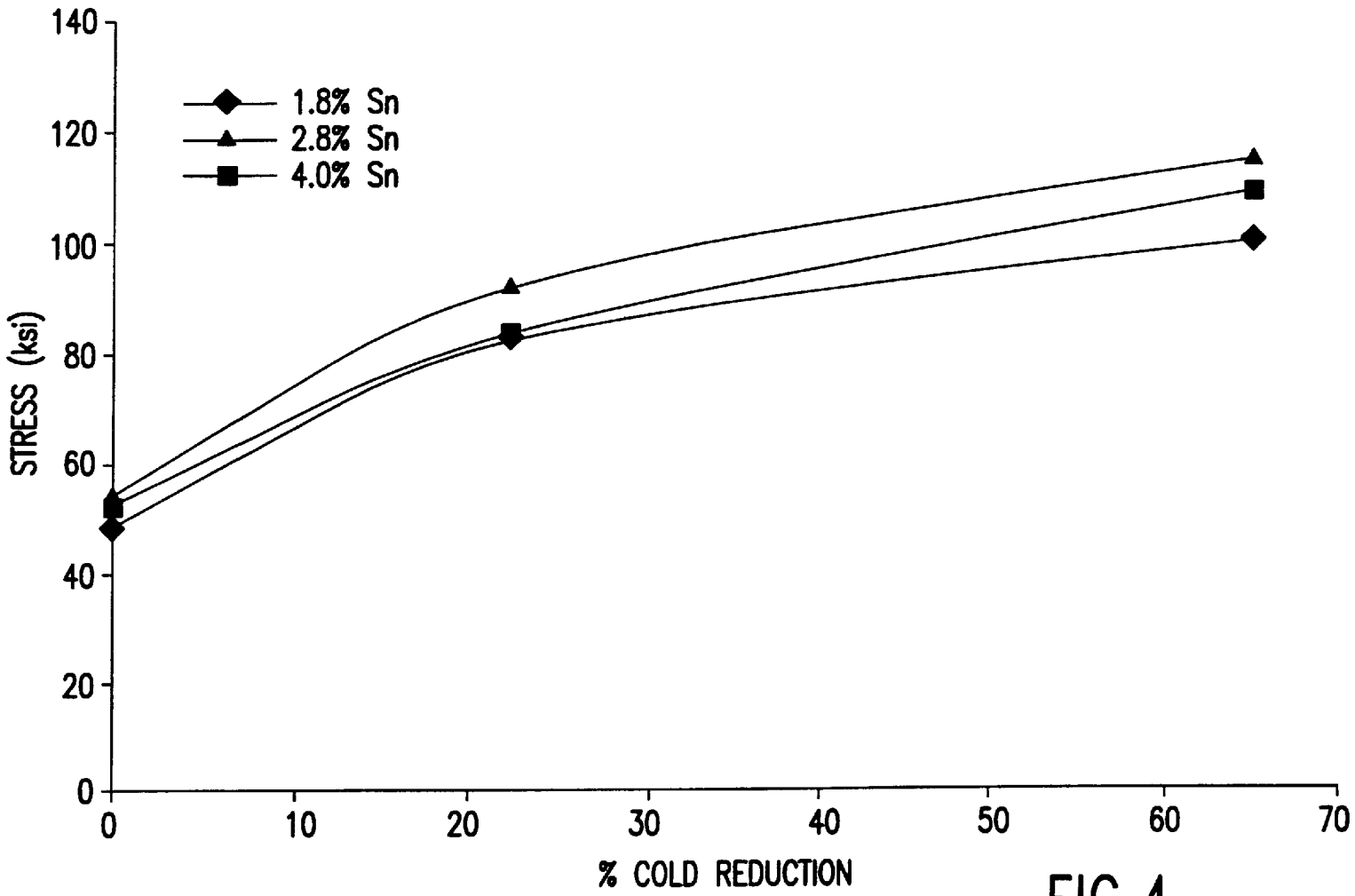
Figure 5:
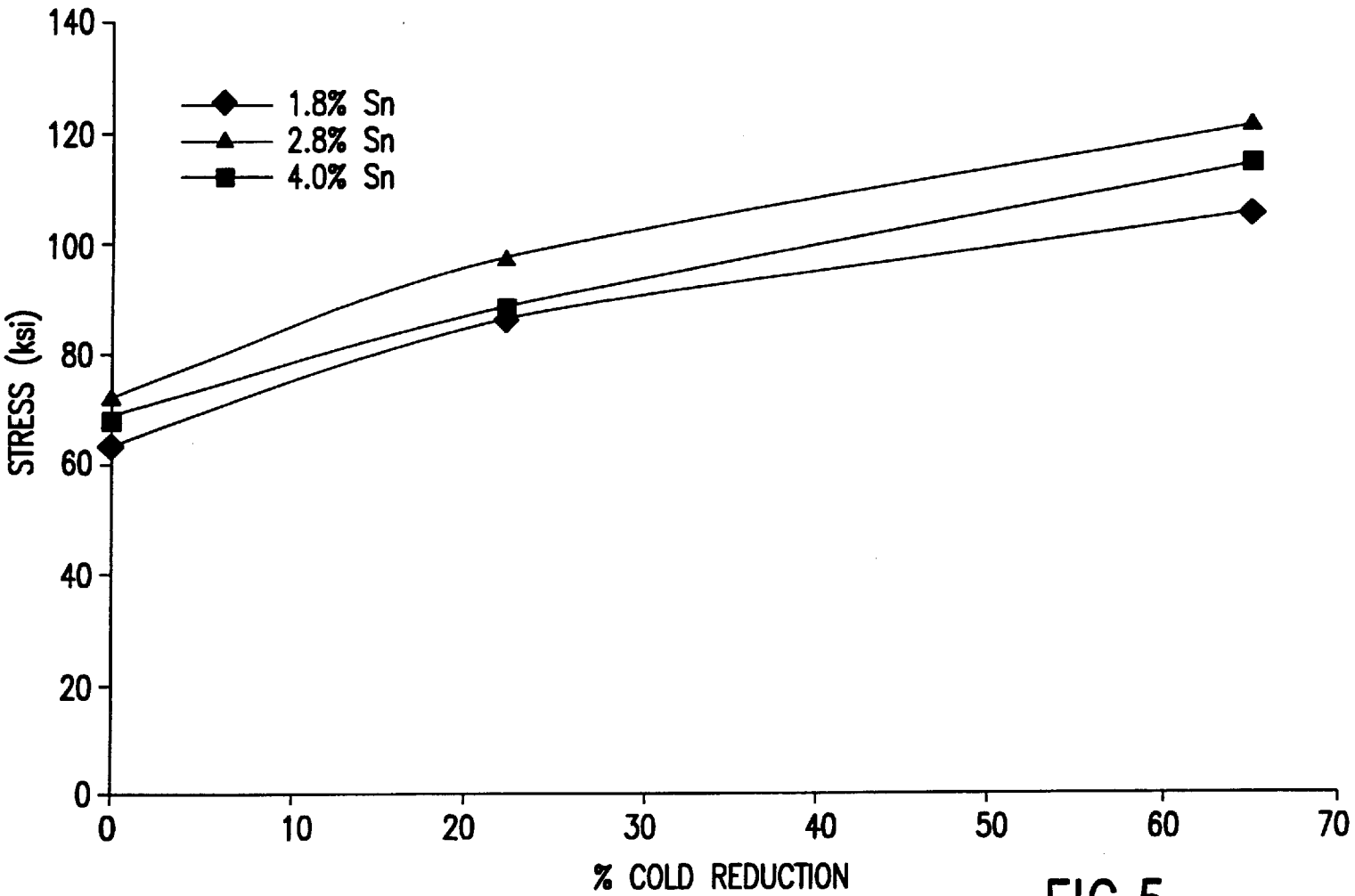

FIG. 4 graphically illustrates that increasing the tin content leads to an increase in yield strength. While FIG. 5 graphically illustrates the same effect from tin additions for the ultimate tensile strength.

Since the strength increase is monatomic with the amount of tin while the conductivity decreases, the tin content should be a trade-off between desired strength and conductivity.

Example 3

Copper alloys containing 1.9% iron, 1.8% tin, 0.04% phosphorous, between 0% and 15% zinc and the balance copper were processed according to FIG. 1. Test coupons in the relief anneal condition 28, were evaluated for yield strength and ultimate tensile strength.

Figure 6:
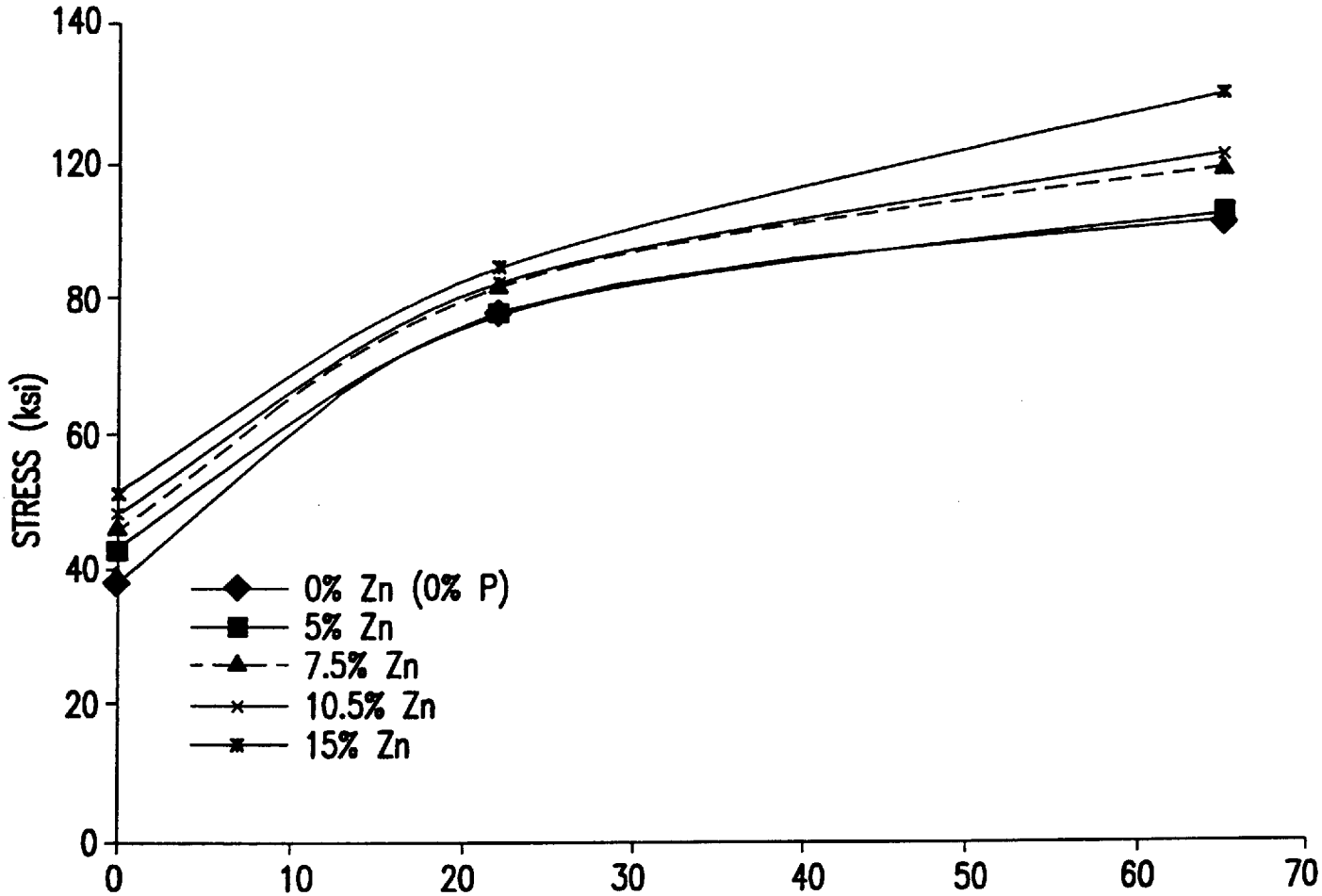

FIG. 6 graphically illustrates that a zinc content of less than about 5% does not contribute to the strength of the alloy, and as discussed above, does not enhance the grain refining capability of the iron. Above 5% zinc, the alloy strength is increased, although a decrease in electrical conductivity is experienced.

Figure 7:
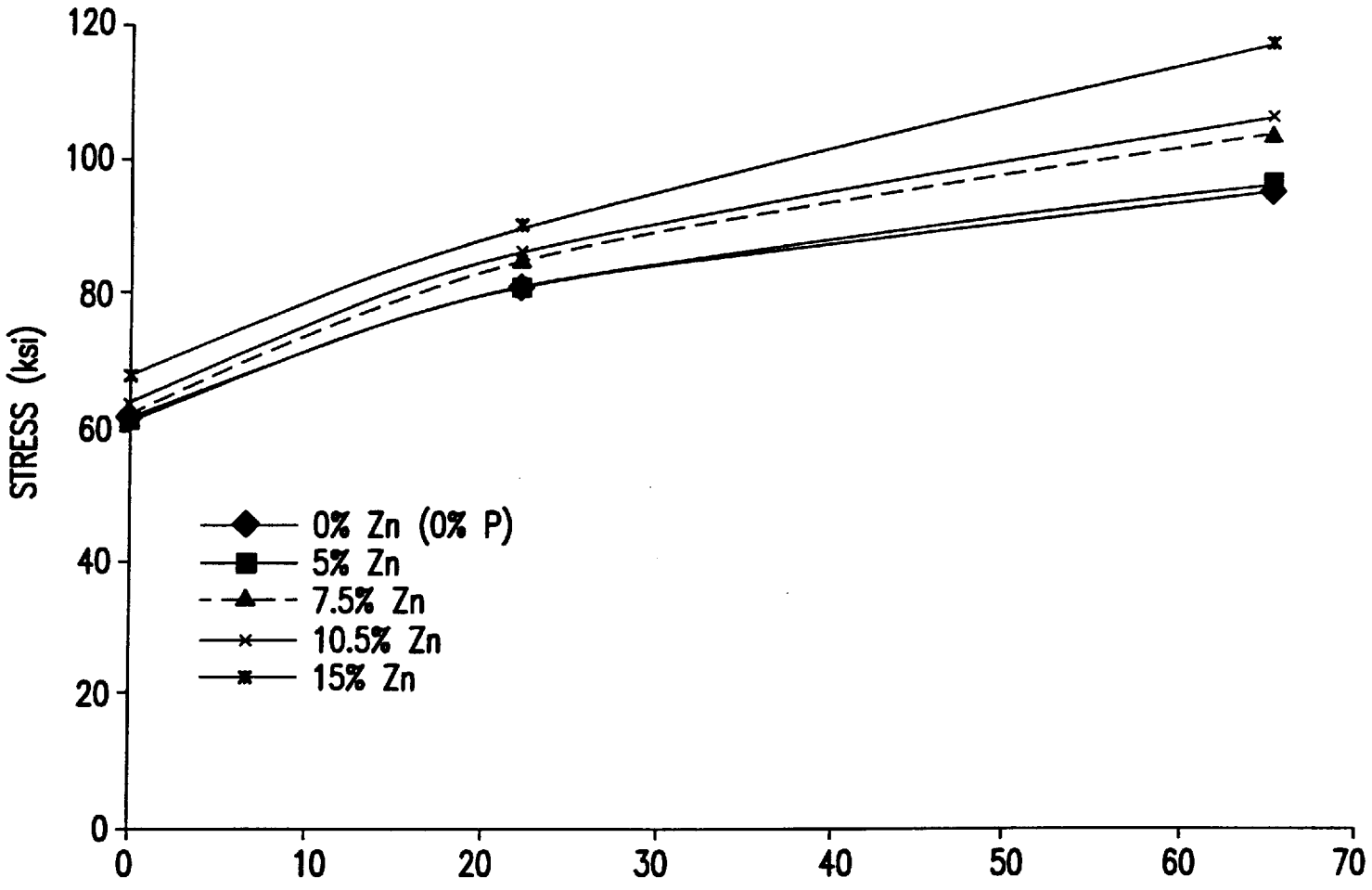

FIG. 7 graphically illustrates the same effect from zinc additions for the ultimate tensile strength of the alloy.

Example 4

Table 3 illustrates a series of alloys processed according to FIG. 1. Alloy A is an alloy of the type disclosed in Caron et al. SN 08/591,065. Alloys B and C are in accordance with the present invention and alloy D is conventional copper alloy C510. All properties were measured when the alloy was in a spring temper following a 70% cold roll reduction in thickness.

TABLE 3

| Alloy | Composition | Elec. Conduct. % IACS | Tensile Strength (ksi) | Yield Strength (ksi) |
|---|---|---|---|---|
| A | 1.8 Sn<br>2.2 Fe<br>0.06 P<br>balance Cu | 33% | 99 | 96 |
| B | 1.8 Sn<br>2.2 Fe<br>0.06 P<br>5.0 Zn<br>balance CU | 29% | 99 | 94 |

TABLE 3-continued

| Alloy | Composition | Elec. Conduct. % IACS | Tensile Strength (ksi) | Yield Strength (ksi) |
|---|---|---|---|---|
| C | 1.8 Sn<br>2.2 Fe<br>0.06 P<br>10.0 Zn<br>balance Cu | 25% | 108 | 101 |
| D | 4.27 Sn<br>0.033 P<br>balance Cu | 17% | 102 | 96 |

Table 3 shows that the addition of 5% zinc did not increase the strength of the alloy and slightly reduced electrical conductivity. A 10% zinc addition had a favorable impact on the strength.

The benefit of the zinc addition is more apparent in view of Table 4 where the strength to rolling reduction is compared.

TABLE 4

| Alloy | % Red. | YS | TS | MBR/t GW | MBR/t BW |
|---|---|---|---|---|---|
| A | 25 | 80 | 83 | 1.0 | 1.3 |
| C | 25 | 84 | 88 | 0.8 | 1.6 |
| A | 33 | 83 | 86 | 1.0 | 1.3 |
| C | 33 | 89 | 94 | 0.9 | 2.1 |
| A | 58 | 96 | 99 | 1.7 | 3.9 |
| C | 60 | 96 | 102 | 1.6 | 6.4 |
| A | 70 | 100 | 104 | 1.9 | 6.3 |
| C | 70 | 101 | 108 | 1.9 | ≧7 |

% Red. = percent reduction in thickness at the final cold step (reference numeral 26 in FIG. 1).
YS = Yield strength in ksi.
TS = Tensile strength in ksi.
MBR/t (GW) = Good way bends about a 180° radius of curvature.
MBR/t (BW) = Bad way bends about a 180° radius of curvature.

A further benefit of the zinc addition is the improved good way bends achieved with alloy C. Bend formability was measured by bending a 0.5 inch wide strip 180° about a mandrel having a known radius of curvature. The minimum mandrel about which the strip could be bent without cracking or "orange peeling" is the bend formability value. The "good way" bend is made in the plane of the sheet and perpendicular to the longitudinal axis (rolling direction) during thickness reduction of the strip. "Bad way" is parallel to the longitudinal axis. Bend formability is recorded as MBR/t, the minimum bend radius at which cracking or orange peeling in not apparent, divided by the thickness of the strip.

Usually, an increase in strength is accompanied by a decrease in bend formability. However, with the alloys of the invention, an addition of 10% zinc increases both the strength and the good way bends.

While described particularly in terms of direct chill casting, the alloys of the invention may be cast by other processes as well. Some of the alternative processes have higher cooling rates such as spray casting and strip casting. The higher cooling rates reduce the size of the properitectic iron particles and are believed to shift the critical maximum iron content to a higher value such as 4%.

It is apparent that there has been provided in accordance with the invention an iron modified phosphor bronze that fully satisfies the objects, means and advantages set forth hereinabove. While the invention has been described in combination with embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A copper alloy, consisting essentially of:

from 1% to 4% by weight of tin;

from 0.8% to 4.0% by weight of iron;

from 8% to 20% by weight of zinc;

amount effective to promote the formation of iron phosphide up to 0.4% by weight of phosphorous; and the remainder copper and inevitable impurities, said alloy having a refined as-cast average crystalline grain size of less than 100 microns and precipitates selected from the group consisting of iron and iron phosphide via dispersion hardening.

2. The copper alloy of claim 1 wherein said zinc is present in an amount from 8% to 12% by weight.

3. The copper alloy of claim 2 wherein a portion of said zinc is replaced at a 1:1 atomic ratio with an element selected from the group consisting of aluminum, manganese and mixtures thereof.

4. The copper alloy of claim 1 wherein the iron content is from 1.6 percent to 2.2 percent.

5. The copper alloy of claim 4 wherein said iron content is from 1.6% to 1.8% by weight.

6. The copper alloy of claim 4 wherein a portion of said zinc is replaced at a 1:1 atomic ratio with an element selected from the group consisting of aluminum, manganese and mixtures thereof.

7. The copper alloy of claim 5 wherein said tin content is from 1.2% to 2.2%.

8. The copper alloy of claim 7 wherein said phosphorous content is from 0.03% to 0.3%.

9. The copper alloy of claim 7 further containing an addition selected from the group consisting of nickel, cobalt, magnesium, beryllium, silicon, zirconium, titanium, chromium and mixtures thereof, wherein each component of said addition is present in an amount of less than 0.4% by weight.

10. The copper alloy of claim 7 being wrought to a thickness of from 0.005 inch to 0.015 inch and having an average final gauge grain size of from 3 microns to 20 microns.

11. An electrical connector formed from the alloy of claim 7.

12. A spring formed from the alloy of claim 10.

* * * * *